US005232818A

United States Patent [19]

Machonkin et al.

[11] Patent Number: 5,232,818

[45] Date of Patent: Aug. 3, 1993

[54] NUCLEATED HIGH CONTRAST PHOTOGRAPHIC ELEMENTS CONTAINING THIOETHER COMPOUNDS TO INHIBIT PEPPER FOG AND RESTRAIN IMAGE SPREAD

[75] Inventors: Harold I. Machonkin, Webster; Donald L. Kerr, Rochester, both of N.Y.

[73] Assignee: Eastman Kodak Company, Rochester, N.Y.

[21] Appl. No.: 735,975

[22] Filed: Jul. 25, 1991

[51] Int. Cl.[5] ..... G03C 1/06

[52] U.S. Cl. ..... 430/264; 430/603; 430/611; 430/598

[58] Field of Search ..... 430/264, 603, 611, 598

[56] References Cited

U.S. PATENT DOCUMENTS

| | | | |
|---|---|---|---|
| 3,220,839 | 3/1965 | Herz et al. | 430/428 |
| 4,221,857 | 7/1980 | Okutsu et al. | 430/264 |
| 4,272,606 | 6/1981 | Mifune et al. | 430/264 |
| 4,276,374 | 6/1981 | Mifume et al. | 430/611 |
| 4,975,354 | 12/1990 | Machonkin et al. | 430/264 |
| 4,988,604 | 1/1991 | Machonkin et al. | 430/264 |
| 5,041,355 | 8/1991 | Machonkin et al. | 430/264 |
| 5,104,769 | 4/1992 | Looker et al. | 430/264 |
| 5,126,227 | 6/1992 | Machonkin et al. | 430/264 |

FOREIGN PATENT DOCUMENTS

| | | | |
|---|---|---|---|
| 0226184 | 1/1987 | European Pat. Off. . | |
| 0356801 | 11/1990 | European Pat. Off. . | |
| 2296140 | 12/1987 | Japan | 430/611 |

*Primary Examiner*—Charles L. Bowers, Jr.
*Assistant Examiner*—Thomas R. Neville
*Attorney, Agent, or Firm*—Alfred P. Lorenzo

[57] ABSTRACT

Silver halide photographic elements which are capable of high contrast development and are especially useful in the field of graphic arts have incorporated therein a hydrazine compound which functions as a nucleator, an amino compound which functions as an incorporated booster, and a thioether compound which functions to inhibit pepper fog and restrain image spread.

20 Claims, No Drawings

NUCLEATED HIGH CONTRAST PHOTOGRAPHIC ELEMENTS CONTAINING THIOETHER COMPOUNDS TO INHIBIT PEPPER FOG AND RESTRAIN IMAGE SPREAD

FIELD OF THE INVENTION

This invention relates in general to photography and in particular to novel black-and-white photographic elements. More specifically, this invention relates to novel nucleated silver halide photographic elements which are capable of high contrast development and are especially useful in the field of graphic arts.

BACKGROUND OF THE INVENTION

U.S. Pat. No. 4,975,354 issued Dec. 4, 1990, entitled "Photographic Element Comprising An Ethyleneoxy-Substituted Amino Compound And Process Adapted To Provide High Contrast Development", by Harold I. Machonkin and Donald L. Kerr, describes silver halide photographic elements having incorporated therein a hydrazine compound which functions as a nucleator and an amino compound which functions as an incorporated booster. Such elements provide a highly desirable combination of high photographic speed, very high contrast and excellent dot quality, which renders them very useful in the field of graphic arts. Moreover, since they incorporate the booster in the photographic element, rather than using a developing solution containing a booster, they have the further advantage that they are processable in conventional, low cost, rapid-access developers.

While the invention of U.S. Pat. No. 4,975,354 represents a very important advance in the art, improvement in the photographic elements described therein, particularly with regard to pepper fog and image spread characteristics, is needed.

A photographic system depending on the conjoint action of hydrazine compounds which function as nucleators and amino compounds which function as boosters is an exceedingly complex system. It is influenced by both the composition and concentration of the nucleator and the booster and by many other factors including the pH and composition of the developer and the time and temperature of development. The goals of such a system include the provision of enhanced speed and contrast, together with excellent dot quality and low pepper fog.

The goal of achieving low pepper fog is one which is exceptionally difficult to achieve without sacrificing other desired properties such as speed and contrast. (The term "pepper fog" is commonly utilized in the photographic art, and refers to fog of a type characterized by numerous fine black specks). A particularly important film property is "discrimination", a term which is used to describe the ratio of the extent of shoulder development to pepper fog level. Good discrimination, i.e., full shoulder development with low pepper fog, is necessary to obtain good halftone dot quality.

Image spread in photographic elements of the type described in U.S. Pat. No. 4,975,354 involves infectious imagewise development of unexposed photographic silver halide grains in close proximity to exposed photographic silver halide grains. Like pepper fog, image spread is a detrimental nucleation effect, and means for controlling both pepper fog and image spread are critically needed to improve the performance of these photographic elements.

Herz et al, U.S. Pat. No. 3,220,839 issued Nov. 30, 1965, describes the incorporation of certain isothioureas in photographic emulsions to prevent incubation fog. The photographic elements utilizing these emulsions do not contain a hydrazine compound that functions as a nucleating agent nor an incorporated booster and are not subject to pepper fog formation.

Okutsu et al, U.S. Pat. No. 4,221,857 issued Sep. 9, 1980, describes a high contrast silver halide photographic element containing a hydrazine compound that functions as a nucleator and a polyalkylene oxide compound which serves to minimize formation of drag streaks upon development. The photographic element does not contain an amino compound that functions as an incorporated booster.

Mifune et al, U.S. Pat. No. 4,272,606 issued Jun. 9, 1981, describes a high contrast silver halide photographic element containing a contrast enhancing arylhydrazide and, as an agent which increases sensitivity and contrast, a compound having a thioamido moiety in the molecule thereof. The photographic element does not contain an amino compound that functions as an incorporated booster.

European Patent Application No. 0226184 published Jun. 24, 1987 is concerned primarily with pepper-fog-reducing and image-spread-restraining compounds intended to be incorporated in a developing solution and describes the use of certain isothiourea compounds and certain free mercapto-compounds for this purpose. The photographic elements described do not contain an amino compound that functions as an incorporated booster, but an amino compound is preferably incorporated in the developing solution. While incorporation of the isothiourea compounds and free mercapto-compounds in the photographic element is also disclosed, there is no teaching relating to use of these compounds in a photographic element that contains an incorporated booster. Moreover, the isothiourea compounds described are characterized by features such as the presence of solubilizing groups, which adapt them for most effective use in a developing solution and make them unsuitable for incorporation in a photographic element.

Copending commonly assigned U.S. patent application Ser. No. 599,218 filed Oct. 17, 1990, and issued Jun. 30, 1992, as U.S. Pat. No. 5,126,227, "HIgh Contrast Photographic Elements Containing Ballasted Hydrophobic Isothioureas", by Harold I. Machonkin and Donald L. Kerr describes hydrophobic isothiourea compounds comprising a ballasting group, attached to the sulfur atom, which serves to restrict the mobility of the compound and thereby aid in retaining it in the photographic element during development. When incorporated in a silver halide photographic element containing both a hydrazine compound that functions as a nucleator and an amino compound that functions as a booster, the ballasted hydrophobic isothiourea compound is highly effective in reducing pepper fog and also serves to restrain image spread. However, the ballasted hydrophobic isothiourea compounds exhibit certain shortcomings which have hindered their commercial utilization. Thus, for example, the performance of these compounds is significantly affected by the type of silver halide grains employed, i.e., they don't function equally well with all of the different types of silver halides that are useful in high contrast photographic elements employed in the field of graphic arts. The ballasted hydrophobic isothiourea compounds are believed to release a free mercaptan, which is the active species, during the development step. The free mercaptan then binds to the silver. Because the active species is released by an hydrolysis step, the action of the ballasted hydrophobic isothiourea compounds is very strongly affected by the composition and pH of the developer, so that the choice of developer may be unduly restricted.

The present invention is directed toward the objective of providing novel high contrast silver halide photographic elements which exhibit improved characteristics in regard to control of pepper fog and restraint of image spread, while still retaining excellent characteristics with respect to speed, contrast and full shoulder development.

SUMMARY OF THE INVENTION

The present invention provides novel silver halide photographic elements which are adapted to form a high contrast image when development is carried out with an aqueous alkaline developing solution. The novel photographic elements have incorporated therein a hydrazine compound which functions as a nucleator, an amino compound which functions as an incorporated booster, and a thioether compound which functions to inhibit pepper fog and restrain image spread. The thioether compounds which are useful in this invention are compounds which are free of both hydrazino and amino functionality and which:

(1) contain within their structure at least one thio (—S—) group, (2) contain within their structure a group comprised of at least three repeating ethyleneoxy units, and (3) have a partition coefficient (as hereinafter defined) of at least one.

Since the novel photographic elements of this invention have incorporated therein the hydrazine compound which functions as a nucleator, the amino compound which functions as a booster, and the thioether compound which functions to inhibit pepper fog and restrain image spread, they are not dependent on the use of additives in the developing solution for any of these vital functions and can, accordingly, be processed with conventional, low cost, rapid-access developers that are widely used in the field of graphic arts.

DESCRIPTION OF THE PREFERRED EMBODIMENTS

Any hydrazine compound that functions as a nucleator, is capable of being incorporated in the photographic element, and is capable of acting conjointly with the incorporated booster to provide high contrast, can be used in the practice of this invention. Typically, the hydrazine compound is incorporated in a silver halide emulsion used in forming the photographic element. Alternatively, the hydrazine compound can be present in a hydrophilic colloid layer of the photographic element, preferably a hydrophilic colloid layer which is coated to be contiguously adjacent to the emulsion layer in which the effects of the hydrazine compound are desired. It can, of course, be present in the photographic element distributed between or among emulsion and hydrophilic colloid layers, such as undercoating layers, interlayers and overcoating layers.

An especially preferred class of hydrazine compounds for use in the elements of this invention are the hydrazine compounds described in Machonkin et al, U.S. Pat. No. 4,912,016 issued Mar. 27, 1990. These compounds are aryl hydrazides of the formula:

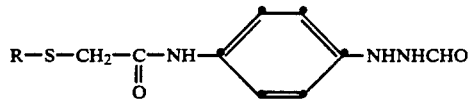

where R is an alkyl or cycloalkyl group.

Another especially preferred class of hydrazine compounds for use in the elements of this invention are the hydrazine compounds described in copending commonly assigned U.S. patent application Ser. No. 167,814, "High Contrast Photographic Element and Emulsion And Process For Their Use", by J. J. Looker, R. E. Leone and L. J. Fleckenstein, filed Mar. 14, 1988 and issued Apr. 14, 1992, as U.S. Pat. No. 5,104,769. The disclosure of this application is incorporated herein by reference in its entirety.

The hydrazine compounds described in the aforesaid patent application Ser. No. 167,814 have one of the following structural formulae:

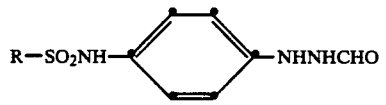

I or

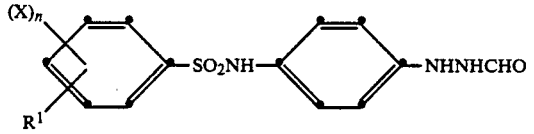

II wherein:

R is alkyl having from 6 to 18 carbon atoms or a heterocylic ring having 5 or 6 ring atoms, including ring atoms of sulfur or oxygen;

$R^1$ is alkyl or alkoxy having from 1 to 12 carbon atoms;

X is alkyl, thioalkyl or alkoxy having from 1 to about 5 carbon atoms; halogen; or $—NHCOR^2$, $—NHSO_2R^2$, $—CONR^2R^3$ or $—SO_2NR^2R^3$ where $R^2$ and $R^3$, which can be the same or different, are hydrogen or alkyl having from 1 to about 4 carbon atoms; and n is 0, 1 or 2.

Alkyl groups represented by R can be straight or branched chain and can be substituted or unsubstituted. Substituents include alkoxy having from 1 to about 4 carbon atoms, halogen atoms (e.g. chlorine and fluorine), or $—NHCOR^2$ or $—NHSO_2R^2$ where $R^2$ is as defined above. Preferred R alkyl groups contain from about 8 to about 16 carbon atoms since alkyl groups of this size impart a greater degree of insolubility to the hydrazide nucleating agents and thereby reduce the tendency of these agents to be leached during development from the layers in which they are coated into developer solutions.

Heterocyclic groups represented by R include thienyl and furyl, which groups can be substituted with alkyl having from 1 to about 4 carbon atoms or with halogen atoms, such as chlorine.

Alkyl or alkoxy groups represented by $R^1$ can be straight or branched chain and can be substituted or unsubstituted. Substituents on these groups can be alkoxy having from 1 to about 4 carbon atoms, halogen atoms (e.g. chlorine or fluorine); or —NHCOR$^2$— or —NHSO$_2$R$^2$ where R$^2$ is as defined above. Preferred alkyl or alkoxy groups contain from 1 to 5 carbon atoms in order to impart sufficient insolubility to the hydrazide nucleating agents to reduce their tendency to being leached out of the layers in which they are coated by developer solution.

Alkyl, thioalkyl and alkoxy groups which are represented by X contain from 1 to about 5 carbon atoms and can be straight or branched chain. When X is halogen, it may be chlorine, fluorine, bromine or iodine. Where more than one X is present, such substituents can be the same or different.

Yet another especially preferred class of hydrazine compounds are aryl sulfonamidophenyl hydrazides, containing ethyleneoxy groups which have the formula:

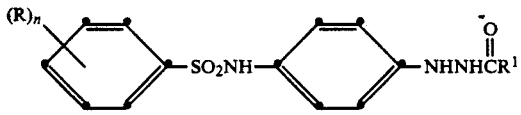

II where each R is a monovalent group comprised of at least three repeating ethyleneoxy units, n is 1 to 3, and R$^1$ is hydrogen or a blocking group.

These hydrazides are described in copending commonly assigned U.S. patent application Ser. No. 528,651, "High Contrast Photographic Element Including An Aryl Sulfonamidophenyl Hydrazide Containing Ethyleneoxy Groups", by H. I. Machonkin and D. L. Kerr, filed May 24, 1990 and issued Aug. 20, 1991, as U.S. Pat. No. 5,041,355, the disclosure of which is incorporated herein by reference in its entirety.

Still another especially preferred class of hydrazine compounds are the compounds described in Machonkin and Kerr, U.S. Pat. No. 4,988,604 issued Jan. 29, 1991. These compounds are aryl sulfonamidophenyl hydrazides containing both thio and ethyleneoxy groups which have the formula:

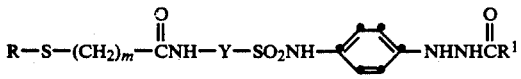

where R is a monovalent group comprised of at least three repeating ethyleneoxy units, m is 1 to 6, Y is a divalent aromatic radical, and R$^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl.

A still further especially preferred class of hydrazine compounds are the compounds described in Looker and Kerr, U.S. Pat. No. 4,994,365, issued Feb. 19, 1991. These compounds are aryl sulfonamidophenyl hydrazides containing an alkyl pyridinium group which have the formula:

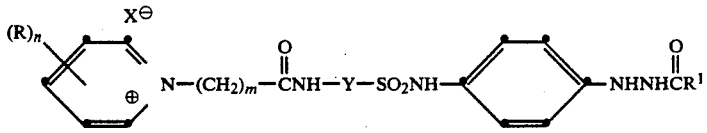

where each R is an alkyl group, preferably containing 1 to 12 carbon atoms, n is 1 to 3, X is an anion such as chloride or bromide, m is 1 to 6, Y is a divalent aromatic radical, and R$^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl. Preferably, the sum of the number of carbon atoms in the alkyl groups represented by R is at least 4 and more preferably at least 8. The blocking group represented by R$^1$ can be, for example:

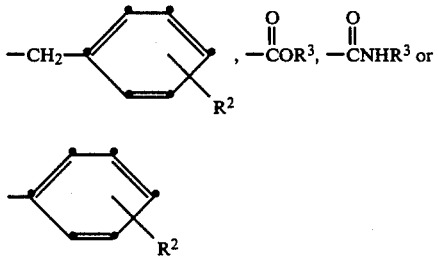

where R$^2$ is hydroxy or a hydroxy-substituted alkyl group having from 1 to 4 carbon atoms and R$^3$ is an alkyl group having from 1 to 4 carbon atoms.

While certain preferred hydrazine compounds that are useful in this invention have been specifically described hereinabove, it is intended to include within the scope of this invention all hydrazine compound "nucleators" known to the art. Many such nucleators are described in "Development Nucleation By Hydrazine And Hydrazine Derivatives", Research Disclosure, Item 23510, Vol. 235, Nov. 10, 1983 and in numerous patents including U.S. Pat. Nos. 4,166,742, 4,168,977, 4,221,857, 4,224,401, 4,237,214, 4,241,164, 4,243,739, 4,269,929, 4,272,606, 4,272,614, 4,311,781, 4,332,878, 4,358,530, 4,377,634, 4,385,108, 4,429,036, 4,447,522, 4,540,655, 4,560,638, 4,569,904, 4,618,572, 4,619,886, 4,634,661, 4,650,746, 4,681,836, 4,686,167, 4,699,873, 4,722,884, 4,725,532, 4,737,442, 4,740,452, 4,912,016 4,914,003, 4,975,354, 4,988,604 and 4,994,365.

The hydrazine compound utilized as a nucleator in this invention is usually employed in an amount of from about 0.005 millimoles to about 100 millimoles per mole of silver and more typically from about 0.1 millimoles to about 10 millimoles per mole of silver.

The hydrazine compounds are employed in this invention in combination with negative-working photographic emulsions comprised of radiation-sensitive silver halide grains capable of forming a surface latent image and a binder. Useful silver halides include silver chloride, silver chlorobromide, silver chlorobromoiodide, silver bromide and silver bromoiodide.

Silver halide grains suitable for use in the emulsions of this invention are capable of forming a surface latent image, as opposed to being of the internal latent image-forming type. Surface latent image silver halide grains are employed in the majority of negative-working silver halide emulsions, whereas internal latent image-forming silver halide grains, while capable of forming a negative image when developed in an internal developer, are usually employed with surface developers to form direct-positive images. The distinction between surface latent image and internal latent image silver halide grains is generally well recognized in the art.

The silver halide grains, when the emulsions are used for lith applications, have a mean grain size of not larger than about 0.7 micron, preferably about 0.4 micron or less. Mean grain size is well understood by those skilled in the art, and is illustrated by Mees and James, *The Theory of the Photographic Process*, 3rd Ed., MacMillan 1966, Chapter 1, pp. 36–43. The photographic emulsions can be coated to provide emulsion layers in the photographic elements of any conventional silver coverage. Conventional silver coverages fall within the range of from about 0.5 to about 10 grams per square meter.

As is generally recognized in the art, higher contrasts can be achieved by employing relatively monodispersed emulsions. Monodispersed emulsions are characterized by a large proportion of the silver halide grains falling within a relatively narrow size-frequency distribution. In quantitative terms, monodispersed emulsions have been defined as those in which 90 percent by weight or by number of the silver halide grains are within plus or minus 40 percent of the mean grain size.

Silver halide emulsions contain, in addition to silver halide grains, a binder. The proportion of binder can be widely varied, but typically is within the range of from about 20 to 250 grams per mol of silver halide. Excessive binder can have the effect of reducing maximum densities and consequently also reducing contrast. For contrast values of 10 or more it is preferred that the binder be present in a concentration of 250 grams per mol of silver halide, or less.

The binders of the emulsions can be comprised of hydrophilic colloids. Suitable hydrophilic materials include both naturally occurring substances such as proteins, protein derivatives, cellulose derivatives, e.g., cellulose esters, gelatin, e.g., alkali-treated gelatin (pigskin gelatin), gelatin derivatives, e.g., acetylated gelatin, phthalated gelatin and the like, polysaccharides such as dextran, gum arabic, zein, casein, pectin, collagen derivatives, collodion, agar-agar, arrowroot, albumin and the like.

In addition to hydrophilic colloids the emulsion binder can be optionally comprised of synthetic polymeric materials which are water insoluble or only slightly soluble, such as polymeric latices. These materials can act as supplemental grain peptizers and carriers, and they can also advantageously impart increased dimensional stability to the photographic elements. The synthetic polymeric materials can be present in a weight ratio with the hydrophilic colloids of up to 2:1. It is generally preferred that the synthetic polymeric materials constitute from about 20 to 80 percent by weight of the binder.

Suitable synthetic polymer materials can be chosen from among poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridines, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamine, N,N-dialkylaminoalkyl acrylates, vinyl imidazole copolymers, vinyl sulfide copolymers, halogenated styrene polymers, amineacrylamide polymers, polypeptides and the like.

Although the term "binder" is employed in describing the continuous phase of the silver halide emulsions, it is recognized that other terms commonly employed by those skilled in the art, such as carrier or vehicle, can be interchangeably employed. The binders described in connection with the emulsions are also useful in forming undercoating layers, interlayers and overcoating layers of the photographic elements of the invention. Typically the binders are hardened with one or more hardeners, such as those described in Paragraph VII, Product Licensing Index, Vol. 92, December 1971, Item 9232, which disclosure is hereby incorporated by reference.

Emulsions according to this invention having silver halide grains of any conventional geometric form (e.g. regular cubic or octahedral crystalline form) can be prepared by a variety of techniques, e.g., single-jet, double-jet (including continuous removal techniques), accelerated flow rate and interrupted precipitation techniques, as illustrated by Trivelli and Smith, *The Photographic Journal*, Vol. LXXIX, May, 1939, pp. 330–338, T. H. James, *The Theory of the Photographic Process*, 4th Ed., MacMillan, 1977, Chapter 3; Terwilliger et al Research Disclosure, Vol. 149, Sep. 1976, Item 14987, as well as U.S. Pat. Nos. 2,222,264; 3,650,757; 3,672,900; 3,917,485; 3,790,387; 3,761,276 and 3,979,213, and German OLS No. 2,107,118 and U.K. Patent Publications 335,925; 1,430,465 and 1,469,480, which publications are incorporated herein by reference.

It is particularly preferred that the silver halide grains are doped to provide high contrast. As is known in the art, use of a suitable doping agent, in concert with the use of a hydrazine compound that functions as a nucleator, is capable of providing an extremely high contrast response. Doping agents are typically added during the crystal growth stages of emulsion preparation, for example, during initial precipitation and/or physical ripening of the silver halide grains. Rhodium is a particularly effective doping agent, and can be incorporated in the grains by use of suitable salts such as rhodium trichloride. Rhodium-doping of the silver halide grains employed in this invention is especially beneficial in facilitating the use of chemical sensitizing agents without encountering undesirably high levels of pepper fog. Doping agents described in McDugle et al, U.S. Pat. No. 4,933,272 as being useful in graphic arts emulsions, can also be advantageously employed. These are hexacoordinated complexes of the formula:

$$[M'(NO)(L')_5]^m$$

wherein m is zero, −1, −2, or −3.

M' represents chromium, rhenium, ruthenium, osmium or iridium, and

L' represents one or a combination of halide and cyanide ligands or a combination of these ligands with up to two aquo ligands.

The silver halide emulsions can be chemically sensitized with active gelatin, as illustrated by T. H. James,

*The Theory of the Photographic Process*, 4th Ed., MacMillan, 1977, pp. 67–76, or with sulfur, selenium, tellurium, platinum, gold, palladium, iridium, osmium, rhenium or phosphorus sensitizers or combinations of these sensitizers, such as at pAg levels of from 5 to 10, pH levels of from 5 to 8 and temperatures of from 30° to 80° C., as illustrated by *Research Disclosure*, Vol. 134, June 1975, Item 13452. The emulsions need not be chemically sensitized, however, in order to exhibit the advantages of this invention.

The silver halide emulsions can be spectrally sensitized with dyes from a variety of classes, including the polymethine dye class, which includes the cyanines, merocyanines, complex cyanines and merocyanines (i.e., tri-, tetra- and polynuclear cyanines and merocyanines), oxonols, hemioxonols, styryls, merostyryls and streptocyanines.

A particularly preferred method of achieving chemical sensitization is by use of a combination of a gold compound and a urea compound as described in copending commonly assigned U.S. patent application Ser. No. 735,979, filed Jul. 25, 1991 entitled "Nucleated High Contrast Photographic Elements Containing Urea Compounds Which Enhance Speed And Increase Contrast", by Anthony Adin. This method provides exceptional results when used with high-chloride silver halide emulsions, i.e., those in which at least the surface portion of the silver halide grains is composed of more than 50 mole percent silver chloride. The combination of the gold compound and urea compound functions to enhance speed and increase contrast in the toe region of the sensitometric curve, without a concurrent increase in fog. Urea compounds effective for this purpose are 1,1,3,3-tetra-substituted middle chalcogen urea compounds in which at least one substituent comprises a nucleophilic center. A combination of potassium tetrachloroaurate and 1,3-dicarboxymethyl-1,3-dimethyl-2-thiourea is especially effective.

The photographic system to which this invention pertains is one which employs a hydrazine compound as a nucleating agent and an amino compound as an incorporated booster. Amino compounds which are particularly effective as incorporated boosters are described in Machonkin and Kerr, U.S. Pat. No. 4,975,354, issued Dec. 4, 1990.

The amino compounds useful as incorporated boosters described in U.S. Pat. No. 4,975,354 are amino compounds which:

(1) comprise at least one secondary or tertiary amino group;

(2) contain within their structure a group comprised of at least three repeating ethyleneoxy units, and (3) have a partition coefficient (as hereinafter defined) of at least one, preferably at least three, and most preferably at least four.

Included within the scope of the amino compounds utilized in this invention as incorporated boosters are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amino compounds employed in this invention as incorporated boosters are compounds of at least 20 carbon atoms.

Preferred amino compounds for use as incorporated boosters are bis-tertiary-amines which have a partition coefficient of at least three and a structure represented by the formula:

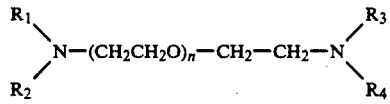

wherein n is an integer with a value of 3 to 50, and more preferably 10 to 50, $R_1$, $R_2$, $R_3$ and $R_4$ are, independently, alkyl groups of 1 to 8 carbon atoms, $R_1$ and $R_2$ taken together represent the atoms necessary to complete a heterocyclic ring, and $R_3$ and $R_4$ taken together represent the atoms necessary to complete a heterocyclic ring.

Another advantageous group of amino compounds for use as incorporated boosters are bis-secondary amines which have a partition coefficient of at least three and a structure represented by the formula:

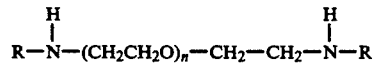

wherein n is an integer with a value of 3 to 50, and more preferably 10 to 50, and each R is, independently, a linear or branched, substituted or unsubstituted, alkyl group of at least 4 carbon atoms.

Preferably the group comprised of at least three repeating ethyleneoxy units is directly linked to a tertiary amino nitrogen atom and most preferably the group comprised of at least three repeating ethyleneoxy units is a linking group joining tertiary amino nitrogen atoms of a bis-tertiary-amino compound.

The most preferred amino compound for use in this invention as an incorporated booster is a compound of the formula:

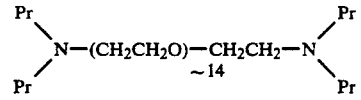

where Pr represents n-propyl.

Other amino compounds useful as incorporated boosters are described in Yagihara et al, U.S. Pat. No. 4,914,003 issued Apr. 3, 1990. The amino compounds described in this patent are represented by the formula:

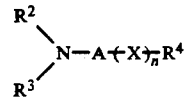

wherein $R^2$ and $R^3$ each represent a substituted or unsubstituted alkyl group or may be linked to each other to form a ring; $R^4$ represents a substituted or unsubstituted alkyl, aryl or heterocyclic group; A represents a divalent linkage; X represents —$CONR^5$—, —O—$CONR^5$, —$NR^5CONR^5$—, —$NR^5COO$—, —COO—, —OCO—, —CO—, —$NR^5CO$—, —$SO_2NR^5$—$NR^5SO_2$—, —$SO_2$—, —S— or —O— group in which $R^5$ represents a hydrogen atom or a lower alkyl group and n represents 0 or 1, with the proviso that the total number of carbon atoms contained in $R^2$, $R^3$, $R^4$ and A is 20 or more.

The amino compound utilized as an incorporated booster is typically employed in an amount of from about 0.1 to about 25 millimoles per mole of silver, and more preferably in an amount of from about 0.5 to about 15 millimoles per mole of silver.

As hereinabove described, the present invention is based on the discovery that thioether compounds are effective in inhibiting pepper fog and restraining image spread in a high contrast photographic system that employs a hydrazine compound as a nucleator and an amino compound as an incorporated booster. In order to inhibit pepper fog and restrain image spread, the thioether compound must be free of both the hydrazino functionality which brings about nucleation and the amino functionality which provides booster activity. In addition to being free of both hydrazino and amino functionality, the useful thioether compounds for the purpose of this invention are those which:

(1) contain within their structure at least one thio (—S—) group, and preferably at least two thio (—S—) groups, (2) contain within their structure a group comprised of at least three repeating ethyleneoxy units, and preferably at least ten repeating ethyleneoxy units; and (3) have a partition coefficient (as hereinafter defined) of at least one, preferably at least three, and most preferably at least four.

By the term "hydrazino functionality", as used herein, is meant the presence of an

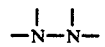

group. Such functionality is essential in the compound that functions as a nucleator.

By the term "amino functionality" as used herein, is meant the presence of a primary, secondary or tertiary amino group.

In this invention, the concentrations of nucleator and booster employed can be varied to control speed, contrast, and to some degree, the shoulder density. However, increases in speed and contrast generally are accompanied by increased levels of pepper fog. Image spread is an additional undesirable consequence of the autocatalytic nucleation process. Development within an area of exposure, such as a halftone dot or a line, triggers nucleation at the dot or line edge to cause the dot or line to increase in size. The nucleated development outside the original exposed area, in turn, triggers further nucleation and the growth process continues with time of development at essentially a constant rate. Thus, an optimized photographic system requires control of both pepper fog and image spread, and such control is provided in a very effective manner by use of the thioether compounds described herein.

Preferably, the thioether compounds utilized in this invention are compounds represented by the formula:

$$R—S—(CH_2CH_2O)_n—R'$$

wherein R and R' are monovalent organic radicals which can be the same or different, and n is an integer with a value of from 3 to 50, and more preferably from 10 to 30. The monovalent organic radicals represented by R and R' preferably contain 1 to 20 carbon atoms.

Suitable monovalent organic radicals represented by R and R' include alkyl groups such as methyl, ethyl, butyl, octyl or dodecyl; cycloalkyl groups such as cyclohexyl; aryl groups such as phenyl or naphthyl; alkaryl groups such as tolyl; aralkyl groups such as benzyl or phenethyl; and heterocyclic groups such as thiazole, thiadiazole, triazole, tetrazole, oxazole, oxadiazole, oxathiazole, diazole, benzopyrazole, benzoxazole, benzothiazole and benzotriazole. The alkyl, cycloalkyl, aryl, alkaryl, aralkyl and heterocyclic groups can be unsubstituted or substituted with substituents such as halo, alkoxy, haloalkyl, sulfo, carboxy, alkoxyalkyl, alkoxycarbonyl, acyl, aryloxy, alkylcarbonamido and alkylsulfonamido.

In the formulas provided herein to define particular thioether compounds, the number of repeating ethyleneoxy groups may be designated as approximately a specified number so as to define an average chain length. Thus, for example, a formula describing a thioether compound with an ethyleneoxy chain length of ~14 indicates a mixture in which some compounds have a chain length of 14, some a chain length of less than 14, and some a chain length of more than 14, and the average chain length is approximately 14.

Particularly preferred thioether compounds for use in this invention are dithio ethers represented by the formula:

$$R—S—(CH_2CH_2O)_n—CH_2—CH_2—S—R'$$

wherein R and R' are alkyl, cycloalkyl, aryl, alkaryl, aralkyl or heterocyclic groups, and can be the same or different, and n is an integer with a value of from 3 to 50, and more preferably from 10 to 30.

Dithio ethers which are symmetrical are especially advantageous for use in this invention, since such compounds are the most easily synthesized. Preferred symmetrical dithio ether compounds can be represented by the formula:

$$R—S—(CH_2CH_2O)_n—R'$$

wherein R is an alkyl, cycloalkyl, aryl, alkaryl, aralkyl or heterocyclic group, R' is $—CH_2CH_2—S—R$, and n is an integer with a value of from 3 to 50, and more preferably from 10 to 30.

Whether the thioethers are monothio ethers or dithioethers, they are preferably compounds containing within their structure at least twenty carbon atoms.

Typical specific examples of thioether compounds useful in this invention include the following:

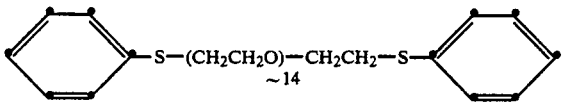

I.

-continued
II.
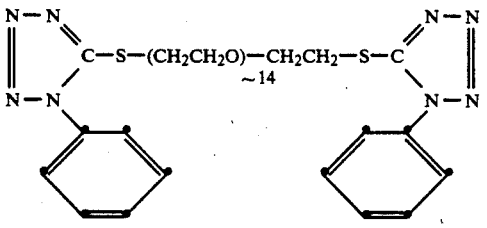
III.
$CH_3CH_2CH_2CH_2-S-(CH_2CH_2O)_{\sim 14}-CH_2CH_2-S-CH_2CH_2CH_2CH_3$
IV.
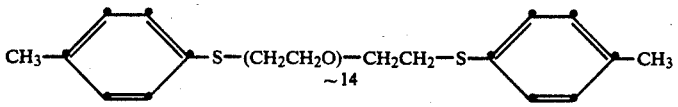
V.
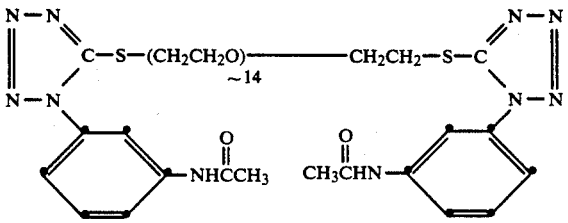
VI.
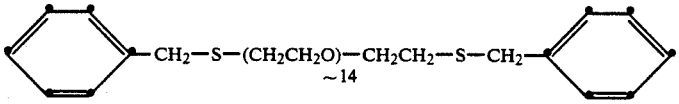
VII.
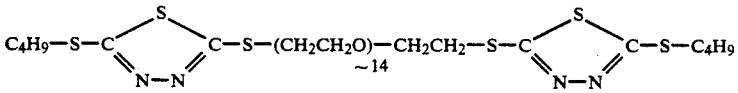
VIII.
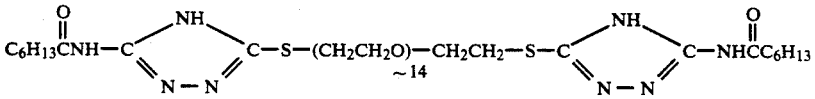
IX.
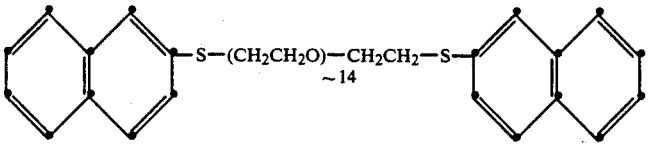
X.
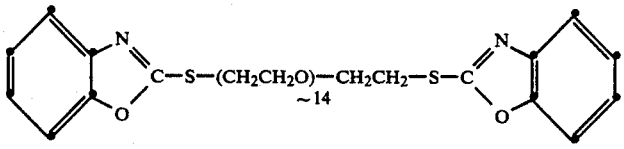
XI.
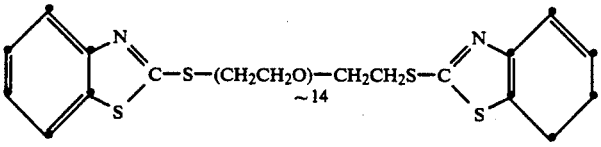
XII.
$C_4H_9-(OCH_2CH_2)_4-S-CH_2CH_2-O-CH_2CH_2-S-(CH_2CH_2O)_4-C_4H_9$
XIII.
$C_4H_9-(OCH_2CH_2)_4-S-CH_2CH_2-S-CH_2CH_2-S-(CH_2CH_2O)_4-C_4H_9$
XIV.
$C_2H_5-S-CH_2CH_2-S-(CH_2CH_2O)_{\sim 14}-CH_2CH_2-S-CH_2CH_2-S-C_2H_5$ -continued $C_4H_9-S-CH_2CH_2-S-(CH_2CH_2O)_{\sim 14}-CH_2CH_2-S-CH_2CH_2-S-C_4H_9$ XV.

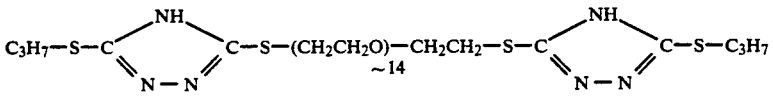
XVI.

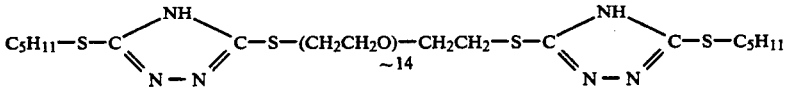
XVII.

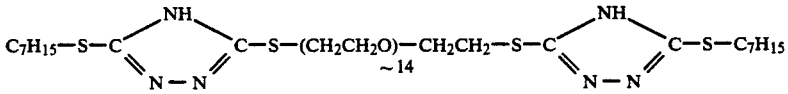
XVIII.

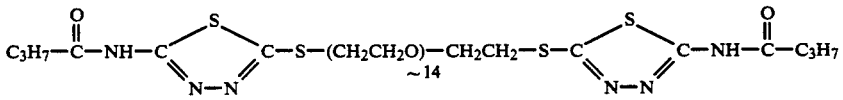
XIX.

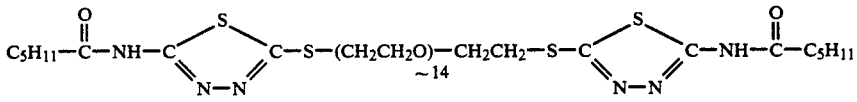
XX.

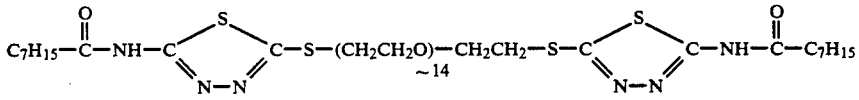
XXI.

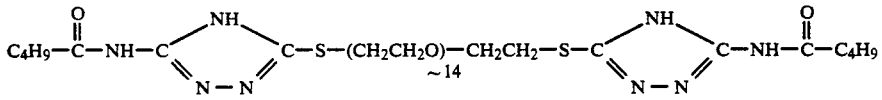
XXII.

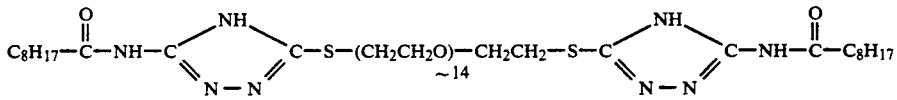
XXIII.

The thioether compound utilized herein is typically employed in an amount of from about 0.1 to about 25 millimoles per mole of silver, and more preferably in an amount of from about 0.2 to about 5 millimoles per mole of silver.

It will be noted that in the preferred embodiment of the invention in which the hydrazine compound is an aryl sulfonamidophenyl hydrazide containing both thio and ethyleneoxy groups, as described in U.S. Pat. No. 4,988,604, and the incorporated booster is an amino compound as described in U.S. Pat. No. 4,975,354, the presence of a group comprised of at least three repeating ethyleneoxy groups is a common feature of the nucleator, the booster and the compound which functions to inhibit pepper fog and restrain image spread. Such a polyethyleneoxy group has a common role in all three types of compounds, namely, the role of enabling the active agents to be easily incorporated in the photographic element, yet be effectively retained to perform their respective functions during development. The active functional groups, however, are the hydrazino group in the nucleator, the amino group in the booster and the thio group in a structure which is free of both hydrazino and amino functionality, in the compound which functions to inhibit pepper fog and restrain image spread.

Particularly preferred sensitizing dyes for use in this invention are the benzimidazolocarbocyanine dyes described in copending commonly assigned U.S. patent application Ser. No. 735,484 filed Jul. 25, 1991, "Nucleated High Contrast Photographic Elements Containing Low-Stain Sensitizing Dyes", by Anthony Adin, Linda J. Knapp, and Steven G. Link. These dyes provide enhanced photographic sensitivity, yet leave substantially no sensitizing dye stain after rapid access processing.

The benzimidazolocarbocyanine sensitizing dyes described in the aforesaid patent application are benzimidazolocarbocyanine sensitizing dyes having at least one acid-substituted alkyl group attached to a nitrogen atom of a benzimidazole ring. Preferred examples of such dyes are those of the formula:

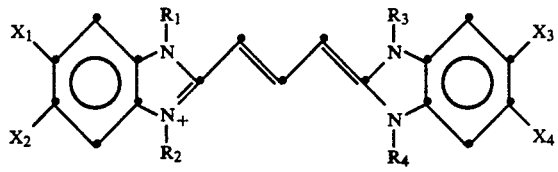

wherein $X_1$, $X_2$, $X_3$ and $X_4$ are, independently, hydrogen, cyano, alkyl, halo, haloalkyl, alkylthio, alkoxycarbonyl, aryl, carbamoyl or substituted carbamoyl, $R_1$ and $R_3$ are alkyl, and $R_2$ and $R_4$ are, independently, alkyl, alkenyl, substituted alkyl or substituted alkenyl with the proviso that at least one of $R_2$ and $R_4$ is acid-substituted alkyl and with the further proviso that when both $R_2$ and $R_4$ are acid-substituted alkyl, there is also a cation present to balance the charge.

The term "partition coefficient", as used herein, refers to the log P value of the compound with respect to the system n-octanol/water as defined by the equation:

$$\log P = \log \frac{[X]_{octanol}}{[X]_{water}}$$

where X=concentration of the compound. The partition coefficient is a measure of the ability of a compound to partition between aqueous and organic phases and is calculated in the manner described in an article by A. Leo, P. Y. C. Jow, C. Silipo and C. Hansch, Journal of Medicinal Chemistry, Vol. 18, No. 9, pp. 865–868, 1975. Calculations for log P can be carried out using MedChem software, version 3.54, Pomona College, Claremont, Calif. The higher the value of log P the more hydrophobic the compound. Compounds with a log P of greater than zero are hydrophobic, i.e., they are more soluble in organic media than in aqueous media, whereas compounds with a log P of less than zero are hydrophilic. A compound with a log P of one is ten times more soluble in organic media than in aqueous media and a compound with a log P of two is one hundred times more soluble in organic media than in aqueous media.

The invention is further illustrated by the following examples of its practice.

EXAMPLES 1–3

Each coating used in obtaining the data provided in these examples was prepared on a polyester support, using a monodispersed 0.24 micrometer cubic AgBrI (2.5 mol % iodide) iridium-doped emulsion at 3.47 g/m$^2$ Ag, 2.24 g gel/m$^2$, and 0.96 g latex/m$^2$ where the latex is a copolymer of methyl acrylate, 2-acrylamido-2-methylpropane sulfonic acid, and 2-acetoacetoxyethylmethacrylate. The silver halide emulsion was spectrally sensitized with 216 mg/Ag mol of anhydro-5,5'-dichloro-9-ethyl-3,3'-di-(3-sulfopropyl) oxacarbocyanine hydroxide, triethylene salt and the emulsion layer was overcoated with gelatin containing polymethyl methacrylate beads. The nucleating agent was added as a methanol solution to the emulsion melts at a level of 2.0 millimoles (mM) per mole of silver. The compound employed as the nucleating agent is represented by the formula:

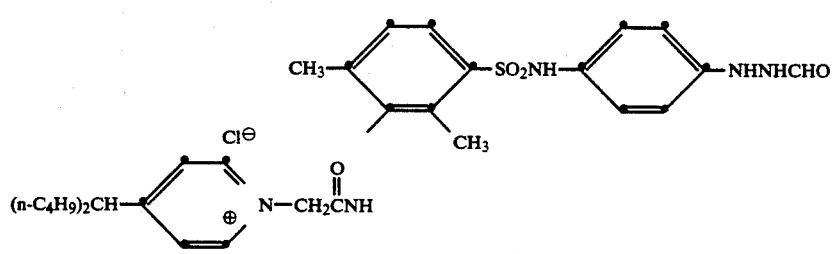

An "incorporated booster" was added as a methanol solution in an amount of 60 milligrams per square meter.

The compound employed as the "incorporated booster" is represented by the formula:

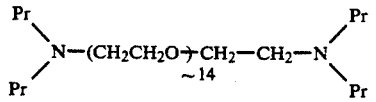

where Pr represents n-propyl.

Thioether compounds I, II and III were incorporated in the emulsion at the concentrations indicated in Table I below. Coatings were exposed through a 0.1 Log E step tablet for five seconds to a 3000° K. tungsten light source and processed for 75 seconds at 35° C. in the developer solution. Processing was carried out in a MOHRPRO 8 tabletop processor.

To prepare the developer solution, a concentrate was prepared from the following ingredients:

| | |
|---|---|
| Sodium metabisulfite | 145 g |
| 45% Potassium hydroxide | 178 g |
| Diethylenetriamine pentaacetic acid pentasodium salt (40% solution) | 15 g |
| Sodium bromide | 12 g |
| Hydroquinone | 65 g |
| 1-Phenyl-4-hydroxymethyl-4-methyl-3-pyrazolidone | 2.9 g |
| Benzotriazole | 0.4 g |
| 1-Phenyl-5-mercaptotetrazole | 0.05 g |
| 50% Sodium hydroxide | 46 g |
| Boric acid | 6.9 g |
| Diethylene glycol | 120 g |
| 47% Potassium Carbonate | 120 g |
| Water to one liter | |

The concentrate was diluted at a ratio of one part of concentrate to two parts of water to produce a working strength developing solution with a pH of 10.5.

An electronic image analyzer was used to scan processed unexposed samples and count the number of pepper fog spots (>10 micrometer diameter) contained in an area of 600 square millimeters. Standard sensitometry exposures were processed and analyzed to monitor speed and shoulder density effects.

Sensitometry parameters are expressed in Table I in terms of the change produced by incorporation of the thioether compound versus the control which contained no thioether compound and was processed under identical conditions. Values are reported for speed, practical density point (PDP, a measure of shoulder development) and pepper fog (PF). Therefore, the changes in speed, practical density point and pepper fog produced by the thiother compound are directly recorded in the table. By definition, the delta log speed, delta PDP and delta log PF for the control are zero.

TABLE I

| Example No. | Thioether Compound | Concentration (millimoles per mole of silver) | Log P | Delta Log Speed* | Delta PDP** | Delta Log PF*** |
|---|---|---|---|---|---|---|
| 1 | I | 0.9 | 5.6 | 0.01 | 0.01 | −0.28 |
| | | 4.4 | | −0.04 | −0.41 | −0.73 |
| 2 | II | 1.1 | 3.5 | −0.01 | 0.14 | −0.47 |
| | | 5.3 | | −0.10 | −0.29 | −1.16 |
| 3 | III | 4.5 | 5.5 | 0.05 | −1.29 | −0.43 |

*DELTA LOG SPEED = LOG $\frac{\text{Control Exposure @ D = 0.6}}{\text{Test Exposure @ D = 0.6}}$

**PDP = Practical Density Point = Density at 0.4 log E Past Speed Point

DELTA PDP = Test PDP − Control PDP

***DELTA LOG PF = LOG $\frac{\text{Number of PF spots in test}}{\text{Number of PF spots in control}}$ (A Delta Log PF of −1.0 represents a reduction in pepper fog of ten times, while a Delta Log PF of −2.0 represents a reduction in pepper fog of one hundred times.)

As indicated by the data in Table I, each of the thioether compounds employed in Examples 1 to 3 brought about a substantial reduction in the level of pepper fog; with Compound II, when used at the higher concentration, reducing the number of pepper fog spots by about fourteen times. No significant reduction in photographic speed occurred with any of compounds I, II or III, and only compound III had a significant adverse effect on shoulder density.

EXAMPLES 4–8

Each coating used in obtaining the data provided in these examples was prepared on a polyester support, using a monodispersed 0.26 micrometer cubic, rhodium-doped, sulfur plus gold sensitized AgCl emulsion at 3.47 g/m$^2$ Ag, 2.24 g gel/m$^2$ and 0.96 g latex/m$^2$. The latex employed was the same as that described in Examples 1 to 3. Sulfur and gold sensitization was provided by addition of 1.5 mg/Ag mole of 1,3-dicarboxymethyl-1,3-dimethyl-2-thiourea and 1.1 mg/Ag mole of potassium tetrachloroaurate. The silver halide emulsion also contained, in amounts of 50, 400, and 200 mg/Ag mole, respectively, the antifoggants 1-(3-acetamidophenyl)-5-mercaptotetrazole, 5-carboxy-4-hydroxy-6-methyl-2-methylmercapto-1,3,3a,7-tetraazaindene and 5-bromo-4-hydroxy-6-methyl-1,3,3a,7-tetraazaindene. The emulsion was spectrally sensitized at 204 mg/Ag mol with a sensitizing dye of the formula:

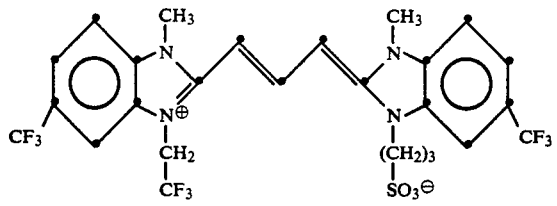

and the emulsion layer was overcoated with gelatin containing polymethylmethacrylate beads. The nucleating agent was added as a methanol solution to the emulsion melts at a level of 0.2 millimoles (mM) per mole of silver. The compound employed as the nucleating agent is represented by the formula:

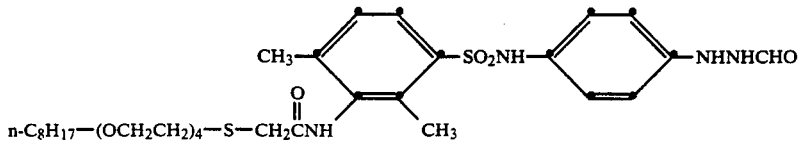

The incorporated booster was the same as that described in Examples 1–3, and it was employed at a concentration of 60 milligrams per square meter.

Thioether compounds IV to VIII were incorporated in the emulsion at the concentrations indicated in Table II below.

The coatings were exposed in the same manner as described in Examples 1–3. The developing solution was also the same as that described, except that it was diluted at a ratio of one part of concentrate to three parts of water, and the pH was adjusted to 10.75. Processing was done in a MOHRPRO 8 tabletop processor at 35° C. with a 37 second development time. The results obtained are reported in Table II.

TABLE II

| Example No. | Thioether Compound | Concentration (millimoles per mole of silver) | Log P | Delta Log Speed | Delta PDP | Delta Log PF |
|---|---|---|---|---|---|---|
| 4 | IV | 0.50 | 6.6 | −0.05 | −0.34 | −1.46 |
| | | 1.00 | | −0.09 | −0.92 | −2.67 |
| 5 | V | 0.50 | 3.6 | −0.07 | 0.79 | −1.46 |
| | | 1.00 | | −0.14 | 0.41 | −3.14 |
| 6 | VI | 0.50 | 5.7 | −0.09 | −1.03 | −2.54 |
| | | 1.00 | | −0.14 | −1.52 | −3.32 |
| 7 | VII | 0.50 | 4.8 | −0.13 | −0.96 | −2.84 |
| 8 | VIII | 0.50 | 4.2 | −0.24 | −0.93 | −3.62 |

As indicated by the data in Table II, each of the thioether compounds employed in Examples 4 to 8 brought about a substantial reduction in the level of pepper fog, with the most active compounds reducing the number of pepper fog spots by a factor of more than one thousand times. The reduction in pepper fog is achieved at the cost of some loss of speed and PDP. However, the most highly active thioether compounds of this invention are so effective in reducing pepper fog that they can be used in very small concentrations to achieve optimum performance in which pepper fog is greatly reduced without unacceptably high losses in speed and/or PDP.

EXAMPLES 9–13

Five of the coatings described in Examples 4–8 were analyzed for the effect upon image spread of the incorporated thioether compound. The coatings tested were those of Examples 4 to 8, respectively, in which the concentration of the thioether compound was 0.50 millimoles per mole of silver.

Image spread measurements were performed by following the growth in diameter of halftone dots with development time. The films were contact exposed to a 52 line/cm 90% tint to produce a 10% exposed dot pattern. The films were then developed in a device that measures the infrared (IR) density during development. The integrated IR halftone density of the developing tint pattern was converted to the equivalent dot diameter using the relation between integrated density and percent dot area. The resulting plots of increasing dot diameter with development time were linear (constant dot growth rate) during the first 60 to 90 seconds of development. The slope of the linear dot diameter versus development response is equal to the dot growth rate reported in Table III below. The developing solution was the same as that described in Examples 1–3, except that it was diluted at a ratio of one part of concentrate to three parts of water, and left unadjusted in pH at 10.55. Corresponding sensitometry tests were run in this developer, at 35° C. and 30 seconds development time, in a KODAMATIC Model 42S Processor. The results obtained are reported in Table III.

TABLE III

| Example No. | Thioether Compound | Log P | Delta Log Speed | Delta PDP | Dot Growth Rate (microns/sec) |
|---|---|---|---|---|---|
| 9 | IV | 6.6 | −0.06 | −0.38 | 0.30 |
| 10 | V | 3.6 | −0.07 | 0.04 | 0.34 |
| 11 | VI | 5.7 | −0.12 | −1.13 | 0.16 |
| 12 | VII | 4.8 | −0.16 | 0.97 | 0.16 |
| 13 | VIII | 4.2 | −0.27 | −0.81 | 0.18 |

The dot growth rate for the control sample which contained no thioether compound was 0.48. As indicated by the data in Table III, the thioether compounds of this invention reduced the rate of dot growth very substantially from the rate of 0.48 microns/sec exhibited by the control. With thioether compounds VI, VII and VIII, the dot growth rate was reduced to only about one third of that of the control.

Use of thioether compounds in accordance with the teachings of this invention provides many important benefits in the field of graphic arts. The thioether compounds provide a means to control both pepper fog and image spread. They are effective with all the different types of silver halides utilized in high contrast photographic elements for the graphic arts. By using them in combination with hydrazine compounds that function as nucleators and amino compounds that function as incorporated boosters, the resulting photographic system provides high speed, high contrast, low pepper fog, good discrimination, freedom from seasoning effects, good dot quality and minimal chemical spread. These benefits are achieved with the hydrazine compound, the amino compound, and the thioether compound all being incorporated in the photographic element, so that conventional low cost developing solutions can be employed.

The thioether compounds of this invention have the further advantage that they can be synthesized from cheap, readily available polyethylene glycols using simple high yield synthetic routes. They do not undergo undesirable interactions with other components of the photographic element, and thereby serve to provide a stable photographic system.

The invention has been described in detail with particular reference to preferred embodiments thereof, but it will be understood that variations and modifications can be effected within the spirit and scope of the invention.

What is claimed is:

1. A silver halide photographic element adapted to form a high contrast image when developed with an aqueous alkaline developing solution; said element comprising:

(1) at least one silver halide emulsion layer, (2) a hydrazine compound that functions as a nucleator, (3) an amino compound that functions as an incorporated booster, and (4) a thioether compound that functions as a pepper fog inhibitor and image spread restrainer, said thioether compound being free of both hydrazino and amino functionality, and (a) containing within its structure at least one thio group, (b) containing within its structure a group comprised of at least three repeating ethyleneoxy units, and (c) having a partition coefficient of at least one.

2. A silver halide photographic element as claimed in claim 1 wherein said hydrazine compound is an aryl sulfonamidophenyl hydrazide of the formula:

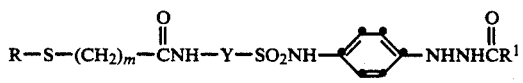

where R is a monovalent group comprised of at least three repeating ethyleneoxy units, m is 1 to 6, Y is a divalent aromatic radical, and $R^1$ is hydrogen or a blocking group.

3. A silver halide photographic element as claimed in claim 1 wherein said amino compound is a compound which (1) comprises at least one secondary or tertiary amino group, (2) contains within its structure a group comprised of at least three repeating ethyleneoxy units, and (3) has a partition coefficient of at least one.

4. A silver halide photographic element as claimed in claim 1 wherein said amino compound is a bis-tertiary amine of the formula:

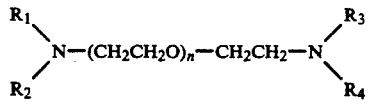

wherein n is an integer with a value of 3 to 50 , $R_1$, $R_2$, $R_3$ and $R_4$ are independently alkyl groups of 1 to 8 carbon atoms, $R_1$ and $R_2$ taken together and $R_3$ and $R_4$ taken together represent the atoms necessary to complete a heterocyclic ring.

5. A silver halide photographic element as claimed in claim 1 wherein said amino compound is a bis-secondary amine of the formula:

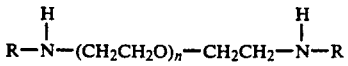

wherein n is an integer with a value of 3 to 50 and each R is independently a linear or branched, substituted or unsubstituted alkyl group of at least 4 carbon atoms.

6. A silver halide photographic element as claimed in claim 1 wherein said thioether compound is represented by the formula:

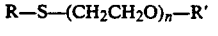

wherein R and R′ are monovalent organic radicals which can be the same or different and n is an integer with a value of from 3 to 50.

7. A silver halide photographic element as claimed in claim 1 wherein said thioether compound is represented by the formula:

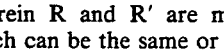

wherein R and R′ are alkyl, cycloalkyl, aryl, alkaryl, aralkyl or heterocyclic groups which can be the same or different and n is an integer with a value of from 3 to 50.

8. A silver halide photographic element as claimed in claim 1 wherein said thioether compound is a dithio ether represented by the formula:

wherein R and R′ are alkyl, cycloalkyl, aryl, alkaryl, aralkyl or heterocyclic groups which can be the same or different and n is an integer with a value of from 3 to 50.

9. A silver halide photographic element as claimed in claim 1 wherein said thioether compound is a symmetrical dithio ether represented by the formula:

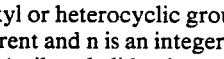

wherein R is an alkyl, cycloalkyl, aryl, alkaryl, aralkyl or heterocyclic group, R′ is a —$CH_2CH_2$—S—R group, and n is an integer with a value of from 3 to 50.

10. A silver halide photographic element as claimed in claim 1 wherein said thioether compound has a partition coefficient of at least three.

11. A silver halide photographic element as claimed in claim 1 wherein said thioether compound has a partition coefficient of at least four.

12. A silver halide photographic element as claimed in claim 1 wherein said thioether compound has the formula:

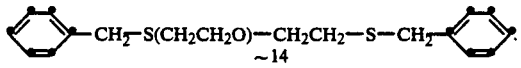

13. A silver halide photographic element as claimed in claim 1 wherein said thioether compound has the formula:

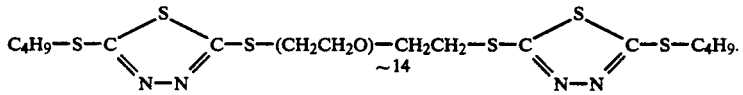

14. A silver halide photographic element as claimed in claim 1 wherein said thioether compound has the formula:

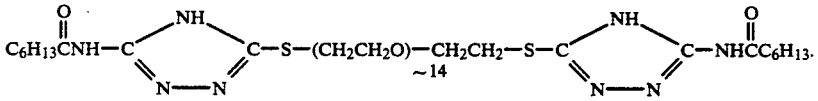

15. A silver halide photographic element as claimed in claim 1 wherein said hydrazine compound is present in an amount of from about 0.1 to about 10 millimoles per mole of silver, said amino compound is present in an amount of from about 1 to about 25 millimoles per mole of silver, and said thioether compound is present in an amount of from about 0.2 to about 5 millimoles per mole of silver.

16. A silver halide photographic element as claimed in claim 1 wherein said silver halide has a mean grain, size of about 0.4 microns or less.

17. A silver halide photographic element as claimed in claim 1 wherein said silver halide is silver bromide or silver bromoiodide.

18. A silver halide photographic element as claimed in claim 1 wherein said silver halide is silver chloride, silver chlorobromide or silver chlorobromoiodide.

19. A silver halide photographic element adapted to form a high contrast image when developed with an aqueous alkaline developing solution, said element comprising:

(1) at least one silver halide emulsion layer, (2) a hydrazine compound that functions as a nucleator, said hydrazine compound having the formula:

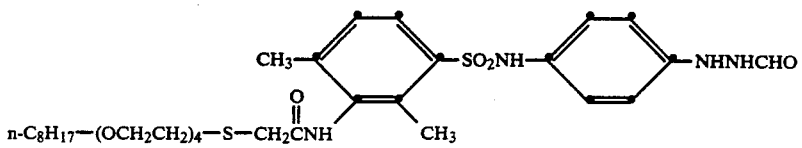

(3) an amino compound that functions as an incorporated booster, said amino compound having the formula:

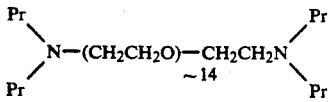

where Pr represents n-propyl, and (4) a thioether compound that functions as a pepper fog inhibitor and image spread restrainer, said thioether compound having the formula:

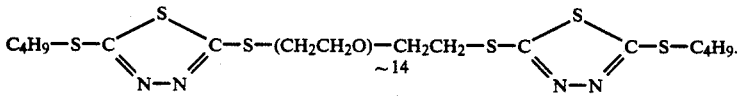

20. A silver halide photographic element adapted to form a high contrast image when developed with an aqueous alkaline developing solution, said element comprising:

(1) at least one silver halide emulsion layer, (2) a hydrazine compound that functions as a nucleator, said hydrazine compound having the formula:

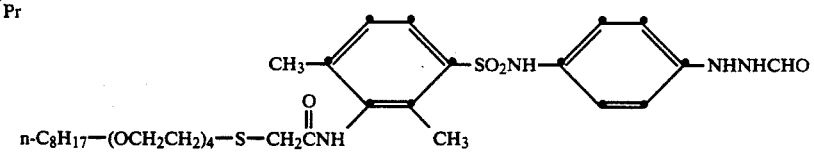

(3) an amino compound that functions as an incorporated booster, said amino compound having the formula:

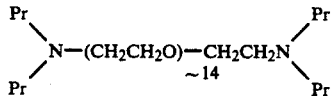

where Pr represents n-propyl, and (4) a thioether compound that functions as a pepper fog inhibitor and image spread restrainer, said thioether compound having the formula:

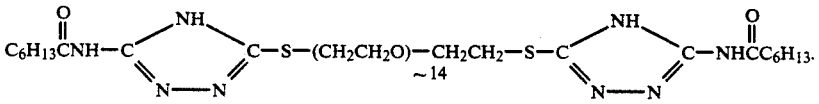

* * * * *